United States Patent [19]

Sebag

[11] Patent Number: 5,009,018

[45] Date of Patent: Apr. 23, 1991

[54] CONTAINER WITH MULTIPLE FUNCTIONS

[76] Inventor: Alain F. Sebag, 1, rue d'Alesia, F-93000 Bobigny, France

[21] Appl. No.: 95,156

[22] PCT Filed: Dec. 9, 1986

[86] PCT No.: PCT/FR86/00429

§ 371 Date: Sep. 18, 1987

§ 102(e) Date: Sep. 18, 1987

[87] PCT Pub. No.: WO87/03564

PCT Pub. Date: Jun. 18, 1987

[30] Foreign Application Priority Data

Dec. 13, 1985 [FR] France ..... 85 18477
Dec. 20, 1985 [FR] France ..... 85 18908

[51] Int. Cl.[5] ..... G09F 3/00
[52] U.S. Cl. ..... 40/306; 47/73
[58] Field of Search ..... 40/152, 152.1, 306, 40/605, 610, 566; 47/66, 72, 73, 83; 232/1 R, 1 A, 17, 24, 37

[56] References Cited

U.S. PATENT DOCUMENTS

| | | | |
|---|---|---|---|
| 166,623 | 8/1875 | Miller | 232/1 A |
| 824,126 | 6/1906 | Little | 40/610 |
| 1,327,778 | 1/1920 | Spangenberg | 232/1 R |
| 1,424,519 | 8/1922 | Richardson | 40/306 |
| 1,445,658 | 2/1923 | Biffle | 232/24 |
| 1,499,473 | 7/1924 | Price | 47/66 |
| 1,569,706 | 1/1926 | Bulwinkle | 40/306 |
| 1,712,858 | 5/1929 | Tsuchii | 47/83 |
| 2,448,945 | 9/1948 | Zacharias | 40/566 |
| 2,543,008 | 2/1951 | French | 40/306 |
| 2,803,923 | 8/1957 | Pratt | 47/83 |
| 3,137,095 | 6/1964 | Pearson | 47/83 |
| 3,332,652 | 7/1967 | Oaks | 47/66 |
| 3,793,756 | 2/1974 | Kay et al. | 40/306 |
| 3,803,738 | 4/1974 | Weiss | 40/306 |
| 3,947,985 | 4/1976 | Skrzypczak | 40/306 |
| 4,001,959 | 1/1977 | Grendahl | 40/152.1 |
| 4,195,729 | 4/1980 | Macken | 40/152 |
| 4,341,040 | 7/1982 | Smith | 47/73 |

*Primary Examiner*—Kenneth J. Dorner
*Assistant Examiner*—J. Hakomaki
*Attorney, Agent, or Firm*—Lackenbach Siegel Marzullo & Aronson

[57] ABSTRACT

A container with multiple functions consists of dual bodies seated one atop the other with a main prism type body resting on a bearing base. The main prism type body is provided with at least four lateral walls, a top surface and at least one receptacle is situated within the main body. The top surface has at least one opening for introducing objects into the receptacle which is accessible through an access door provided in one of the lateral walls. An upper body of smaller dimension being located centrally on the main body. The upper body is defined by at least two side faces extending substantially upwardly from the top surface and separated by a space, so that the opening of the top surface is situated within the space and between two side faces of the upper body. A roof with at least two inclined surfaces extends between and is supported by the side faces of the upper body. A container is positioned within the upper body spaced between the roof and the top surface of the main body. At least one flower stand is situated at a place of junction between the main and upper bodies and extending from the top surface in the direction of the bearing base.

7 Claims, 8 Drawing Sheets

CONTAINER WITH MULTIPLE FUNCTIONS

The present invention relates to a piece of urban furniture whose primary purpose is to display advertising on supports provided therefor, illuminated or not, designed, for example, for posters measuring 40×60 cm. With reference to the attached drawings, this piece of furniture is constituted by a main body (3) resting on a bearing base (2). This body (3) is provided at its upper part with two nested flower stands (5). This body (3) contains at least one container (7) intended to receive objects and accessible through a wide door (8). This body (3) comprises on each of its four faces a display or advertising panel, illuminated or not, forming an advertising support (11). The door (8) acts as one of the advertising support faces. This body (3) is topped by an upper volume (4) of which two faces (9,10) form, each of them, a display panel, illuminated or not, as an advertising display support. The other faces (20), (21) each comprise at least one opening through which are introduced the objects to be received in said furniture. The said upper volume (4) is itself topped by a ridge roof (13).

The upper part (4) can in one case form a basket receptacle for discarded newspapers (12), one face of which forms an advertising support and can be opened to introduce and remove a receptacle (16) resting on the bottom of the said upper part (4), while the container in the lower part of the body (3) is a recipient for refuse, filled through two openings (6) disposed in the horizontal upper part of the said body (3). In another case the upper part (4) of this furniture constitutes a letter box (12), one face of which (21) has a large opening (28) for mail of large formate and the other face (20) on the opposite side, has two openings (26), (27), for example for local and national mail. This upper part (4) communicates in its bottom with the body (3) and has, on the inside, a vertical partition (23) parallel to the faces provided with openings for the various types of mail and extending down to the lower part (3) to divide the furniture in two; one of the halves situated on the side of the two openings being itself provided with a partition (24) perpendicular to the first in order to subdivide it further into two parts in the upper part (4) alone. According to another characteristic, in the case of the letter box, the body (3) is provided on the inside with means of holding three collection bags (7'), (7''), (7''') for the various sorts of mail. These bags will be suspended and placed under the openings, inside the body (3) and level with the upper part of this body (3). There will be two bags side by side, adjoining the two openings and a large bag on the "printed matter" side.

In a preferred embodiment, the flower stands are disposed on two opposite sides of the body (3) on either side of the upper volume (4) and on the sides corresponding to the faces having the openings (17), (26), (27), (28) of the upper volume (4). According to other characteristics applicable to the two uses defined above, this furniture can be made of high-strength, reinforced polyester, although it can also be made of other materials. This furniture will be connected to the public lighting supply for electricity when there are illuminated advertising panels.

A detailed description of the nonlimiting modes of embodiment will be presented with reference to the attached drawings in which.

Figure 1:
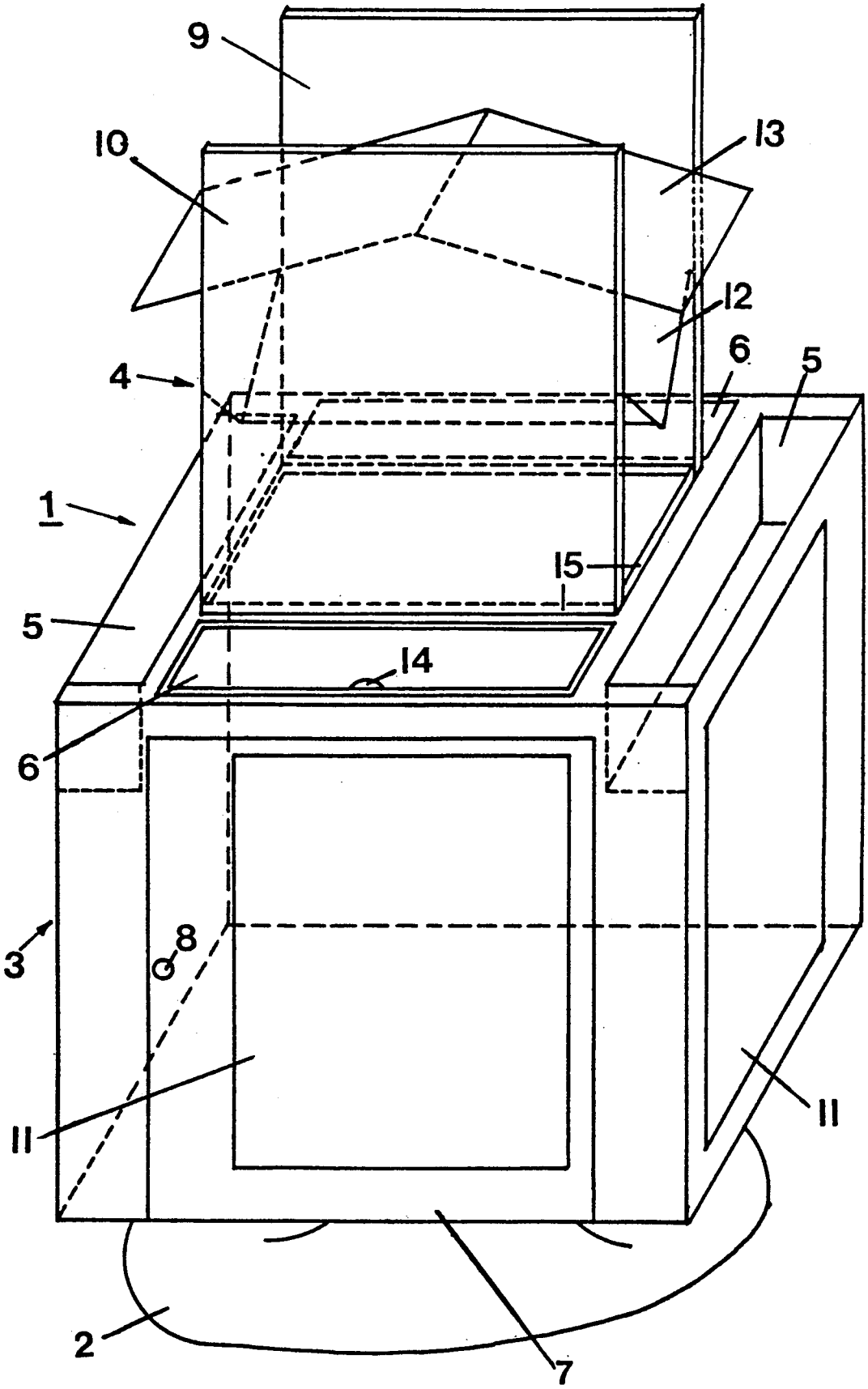
FIG. 1 is a schematic view in perspective of the furniture when used with a newspaper basket and refuse container according to a first embodiment.
Figure 2:
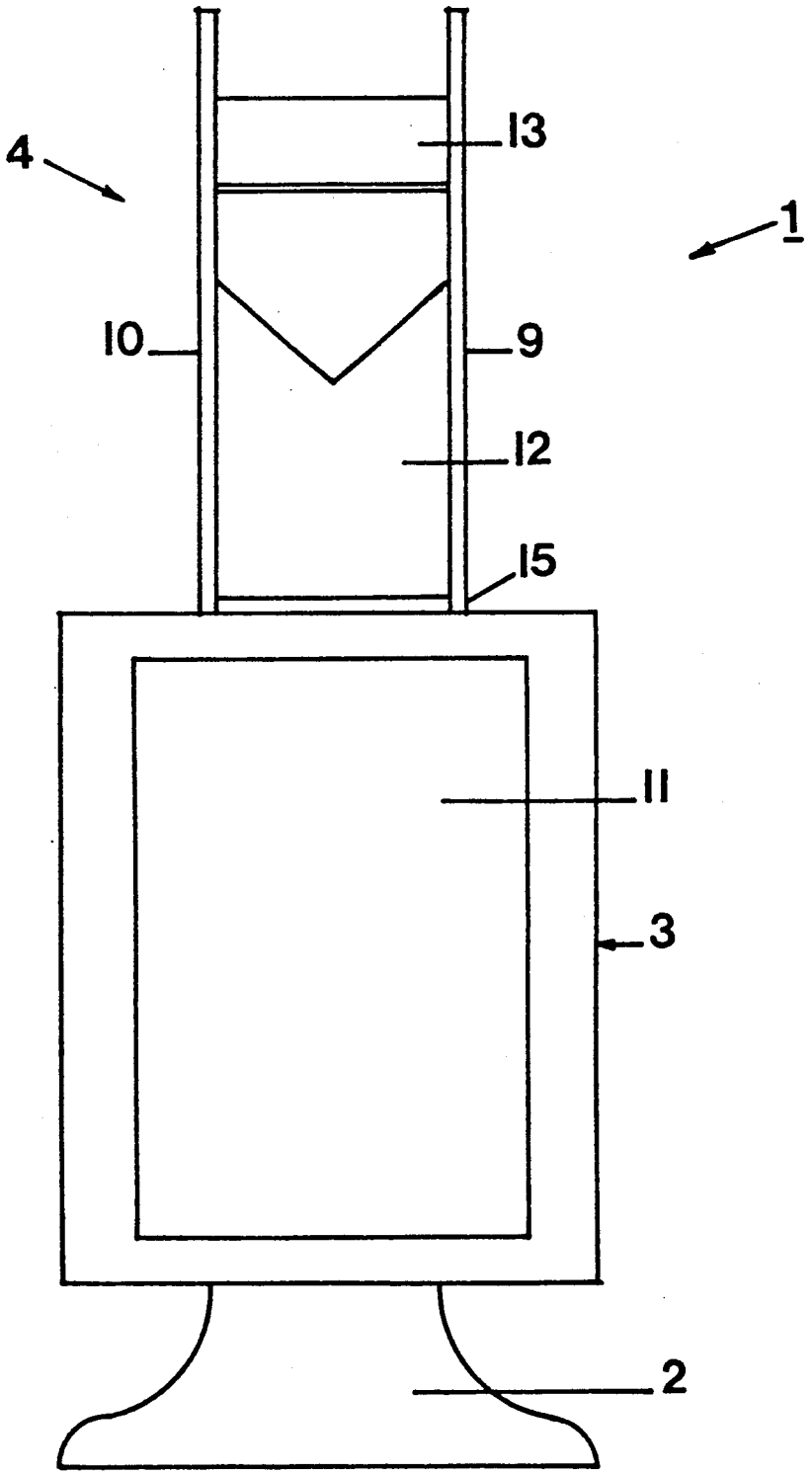
FIG. 2 is a profile view of the furnitute shown in FIG. 1.

The present furniture is described by a perspective view in FIG. 1 and by a FIG. 2 showing a simple profile revealing the newspaper basket (12) and its shelter (13). The perspective view in FIG. 1 shows the various parts constituting the whole which we will call 1.

These three parts are:

The base (2) which has a diameter larger than the distance separating the outer faces of the block delimiting the flower stands 5. This feature will give it perfect stability. Furthermore, the gentle slope of this base insures an easy runoff of water and prevents stagnation of moisture under the furniture.

The body (3) proper whose forms can be different. In the case of the model presented it is a parallelepiped but it can be cylindrical or in some other shape. In any case, the originality of this body consists in the regrouping, on its upper face, of two parallel, nested flower stands (5) and two openings (6), likewise mounted in parallel, which are rectangular and intended for the discard of refuse. These openings will each be concealed by a pivoting cover, lavelled "Paper" which every user will have to raise before dropping an object inside, by means of a handle (14) provided for the purpose; these covers serving an obvious hygienic function. The refuse will be collected in a container (7) placed right inside the body (3) and accesible through a door (8) which can be locked. To empty it, it is merely necessary to remove the container from the enclosure and dump the contents into the garbage truck, the key to the door being in the hands of the services concerned. This container will be slightly wider than each of the openings marked "Paper" and its length will be at least the distance separating the two outer ends of these openings. The door (8) whose lower part will be on the same plane as the lower face of the body (3), will have an opening sufficient to facilitate removal of the containter (7).

The flower stands (5) on the lower face, as well as the lower part of the body (3), will have several perforations to drain off the overflow of watering or rainwater. On this body (3) there will be installed in parallel, in pairs, four support panels, illuminated panels, illuminated or not, for advertising posters of standard dimensions, 40×60 cm at the present time, namely one panel per face.

The upper part (4) composed of two faces (9), (10) mounted in parallel and perpendicularly to the plane of the upper part of the body (3) on a slight superelevation (15). These two faces are connected together in such a way that the whole constitutes a receptacle forming a newspaper basket (12), the obvious utility of which is described below.

This basket will be covered at a height sufficient to permit the easy recovery of the old newspapers by a shelter with two planes, each one slightly inclined toward each opening and projecting on the outside on either side of the broadest part of this basket, which prevents water from penetrating to the inside and thus wetting these newspapers. The use of this basket (12) will be specified by the term "Newspapers". These two parallel faces (9), (10) will also be provided with support panels illuminated or not, for advertising posters of the same dimensions as those installed on the body (3). The two larger faces of the basket (12) are supports for advertising poster panels and they support a roof (13) which is a protective cover for this basket (12). This roof (13) has two inclined sides projecting over the flower stands (5).

Figure 3:
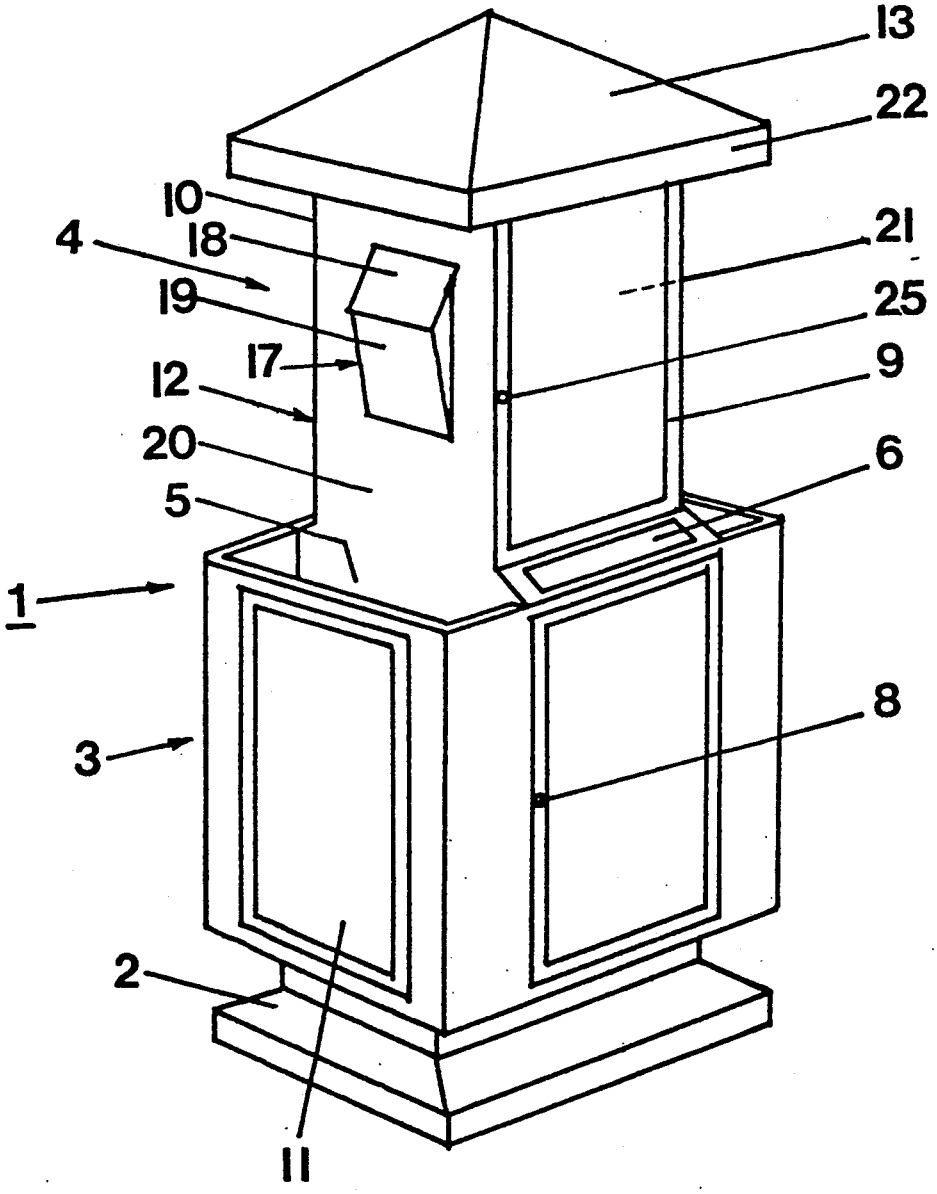
FIG. 3 is a perspective view of the furniture, again when used with a newspaper basket and refuse container according to a second embodiment.
Figure 4:
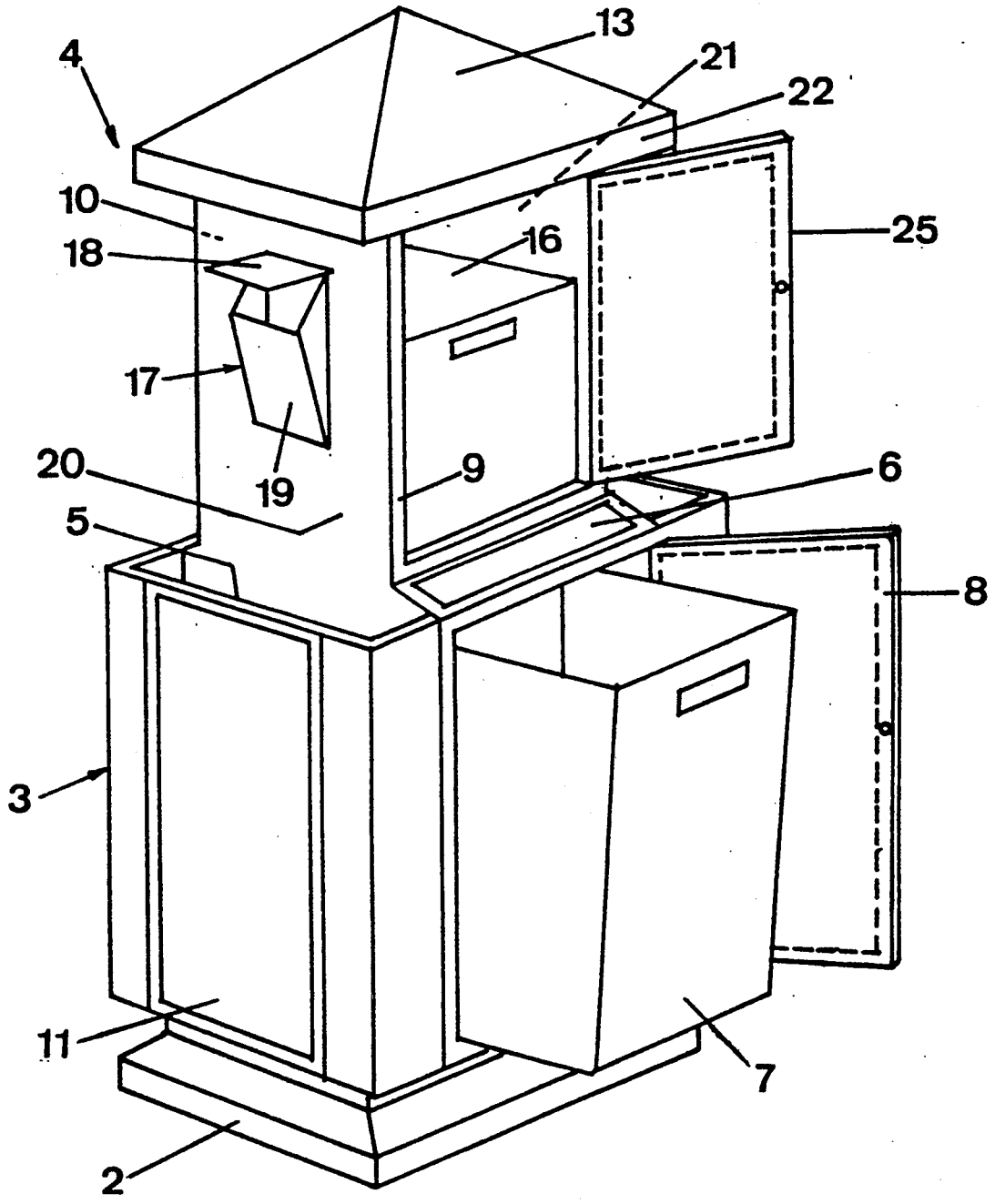
FIG. 4 is a view corresponding to FIG. 3 in open position.

The embodiment illustrated in FIG. 3 and 4 is distinguished by a roof with four sides, gently sloping, of pyramidal shape with a straight lip (22), which can, however, assume any other peripheral form, terminating in a "drip" setback. This roof (13), in the case of FIGS. 3 and 4, covers and encloses an upper volume constituting a basket (12) for newspapers containing a receptacle (16) equipped with a handle and accessible through a door (25) that opens with a key identical to the one for door (8) which can also be furnished to charitable organizations. This door (25) will be on the same plane as the lower part of this basket (12).

According to other characteristics, it will be noted that in the embodiment illustrated in FIGS. 3 and 4, the base (2) has a rectangular form that is equal to, but can be larger than the sides of the body (3), which makes for perfect stability for the furniture. This base (2) can either be simply placed on the ground after being ballasted, or be fixed to the ground by means of a system of attachments such as, for example, by four nuts fully integrated in the inner part of this base (2), whereof the closed upper part will also have systems of attachment penetrating into the interior of the body (3) which will thus rest on the base (2). The value of such a structure of reinforced plastic is that the lower part of the base (2) of the latter can be cut away to adapt this furniture to streets on a slope. The openings (6) which have a slight slope inclined toward the outside of the body (3), have, according to the case of FIGS. 3 and 4, a cover (26) equipped with return springs. This cover (26) will no longer have the handle (14) illustrated in the case of FIGS. 1 and 2 and will constitute an overflow-proof flap with an obvious hygienic function. According to another characteristic with receptacle (7) will be equipped with a handle enabling it to be easily pulled out and hoisted manually and mechanically in order to empty its contents into the garbage truck.

In every figure showing the upper part of the body (3) we note two flower stands (5) constituted by receptacles with water reservoir which are fixed in a receptacle emplacement forming part of the mass of the body (3); a clip system allowing the receptacle with water reservoir to be locked or unlocked from the inside of the body (3) in order to prevent the theft of these flower stands (5). The receptacle emplacement on the flower stand (5) has an orifice connected to a pipe to drain off excess water toward the lower part of the body, outside on the base (2).

In the case of FIGS. 3 and 4, we note that the upper part or volume (4) of the body (3) appears in the form of an entirely closed parallelepiped with two openings (17) projecting from each of the faces (20), (21) into which newspapers can be thrown. These openings (17) have a fixed part (19) on which the seal of the city can be placed, and a mobile part (18) to be raised in order not to encourage the discard of refuse and marked "Newspapers". This mobile part (18) serves as a protective cover against rain or wash water in particular. Nevertheless, the inner bottom of the basket (12), along faces (20), (21), will have a pipe serving as a drain to the lower part of the body (3) on base (2), to assist in carrying off any water that may enter through the access openings (17).

Figure 5:
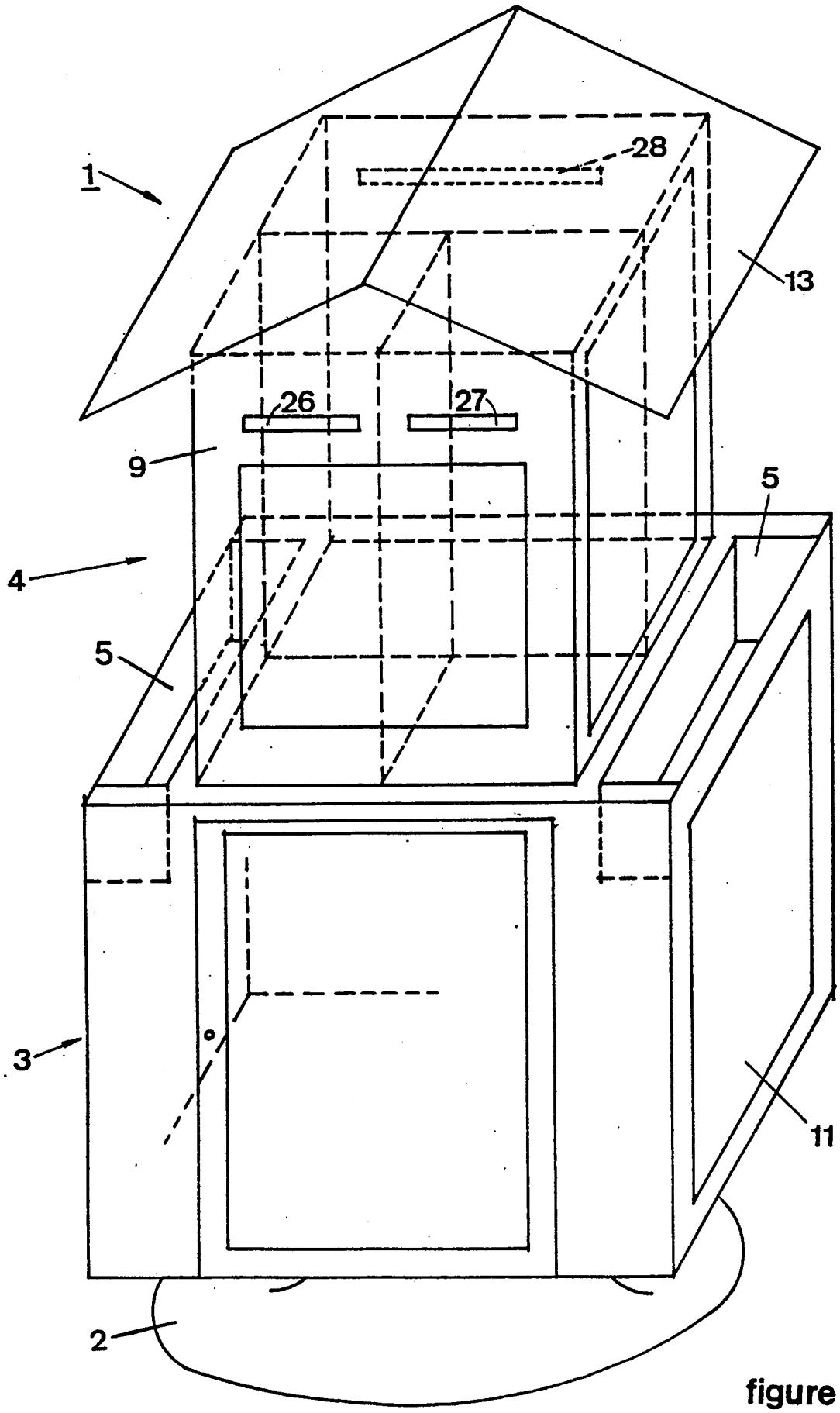
FIG. 5 is a perspective view of the furniture applied to the constitution of a letter box according to a first embodiment.

FIG. 5 illustrates the furniture used as a letter box according to a first embodiment. The base (2) and body (3) parts are similar to those described in reference to FIGS. 1 and 2. But the upper part of the body (3) lacks the openings (6). In the case of FIG. 5, the letter box (12) which is nested between the two flower stands over the entire width of the body (3) is fixed by screws, at points provided for the purpose, in the upper part of the body (3). This letter box (12) for public use, is high enough so that its two larger faces may each support a support panel for advertising posters. This letter box will be protected by a roof (13) with two inclined sides whose lips will project sufficiently beyond the four faces of this letter box so that the access openings for letters, for example for Paris and Greater Paris (26) and for the provinces (27), placed on one of the narrower faces of this letter box will be well protected from rain and wash water. The access opening (28) for printed matter and large-sized envelopes, placed on the face opposite the one for access openings (26), (27) will also be protected by the roof (13). The access openings (27), (28) will have on the outside, facing the public, over their entire perimeter, a projecting part preventing water from penetrating to the interior. The access openings will open at an angle which, by reason of the inclination of the sides of the roof, will nevertheless facilitate the insertion of mail.

Figure 6:
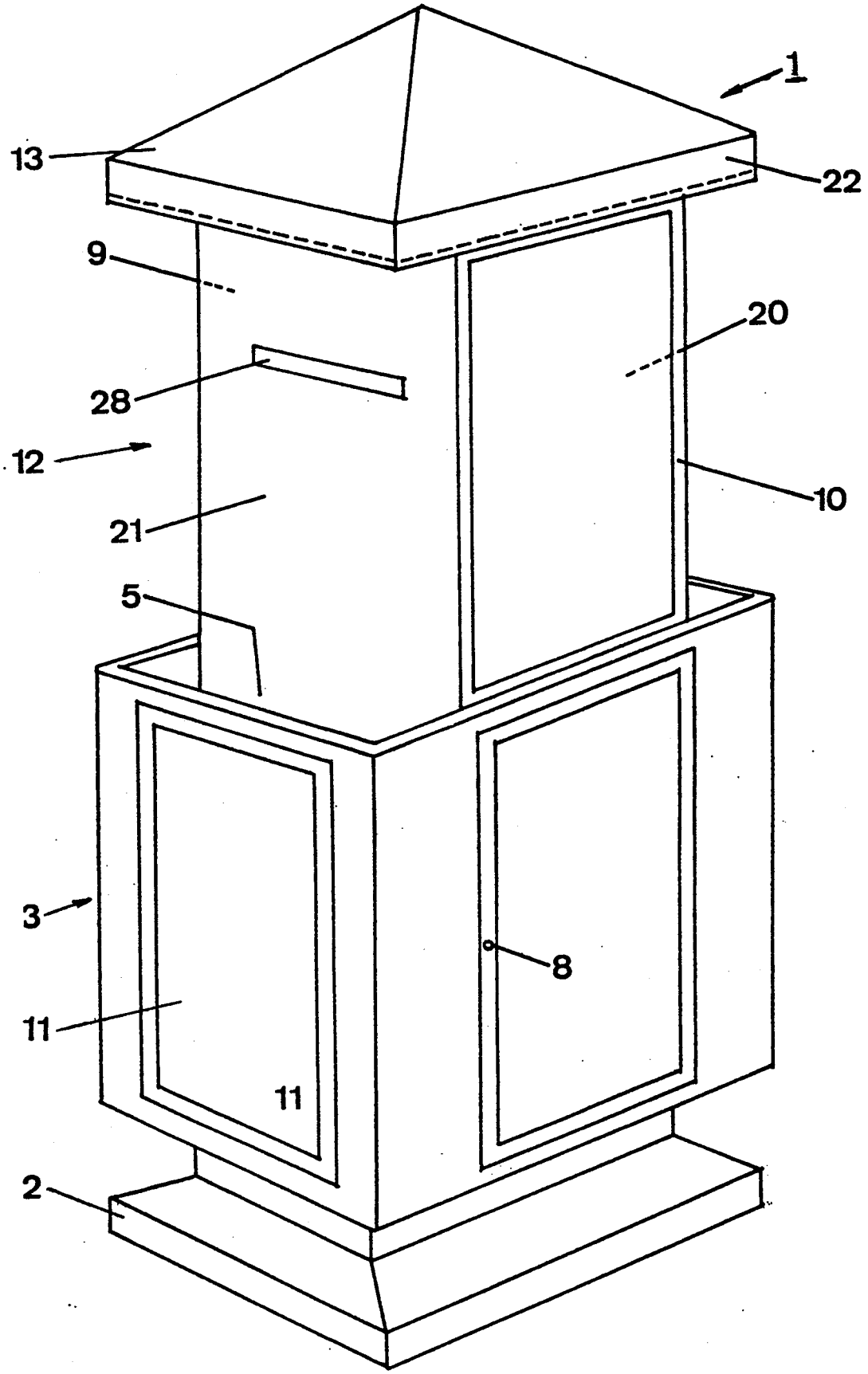
FIG. 6 is a first wide-angle perspective view showing a second embodiment of the furniture, again applied to use with a letter box.
Figure 7:
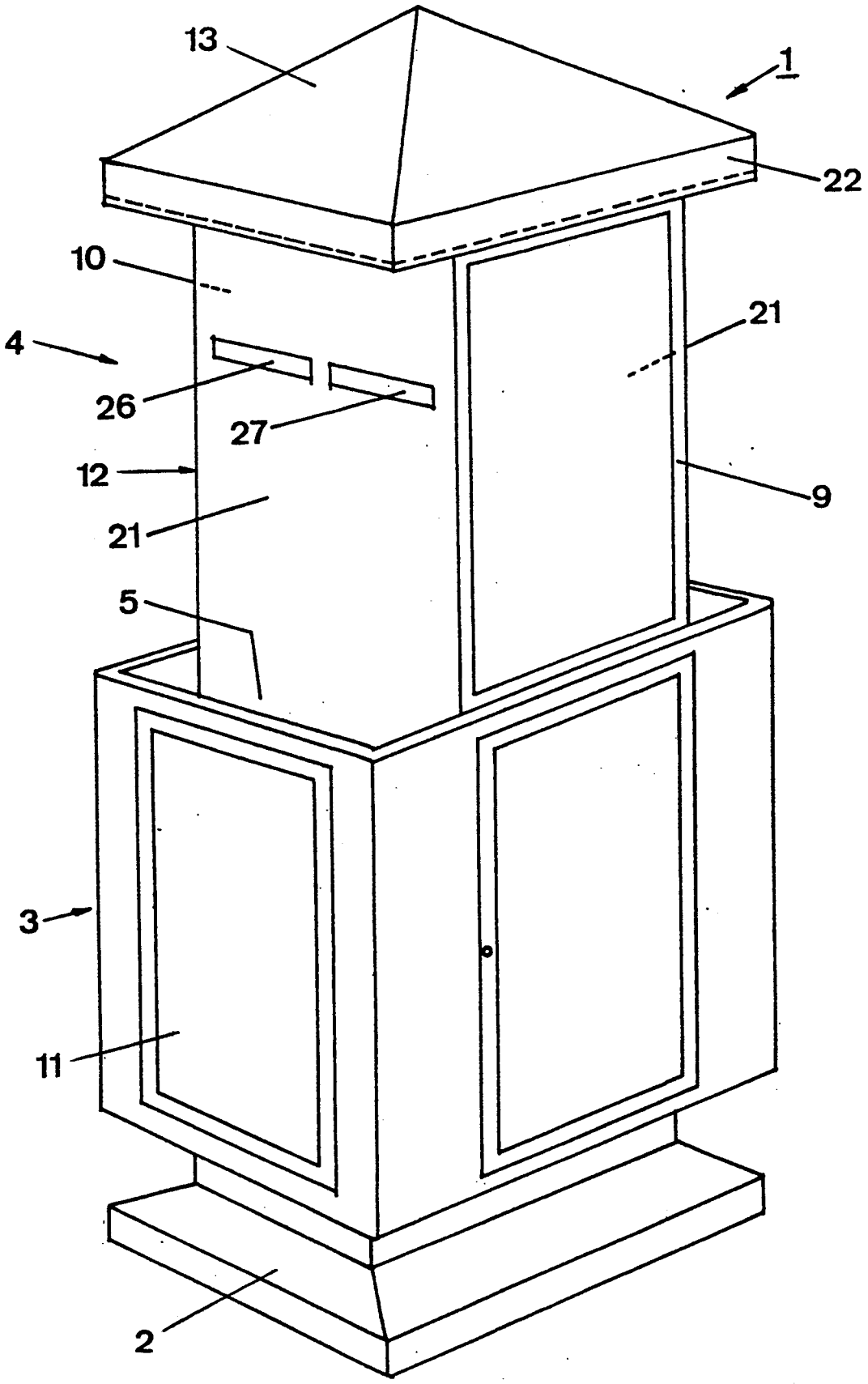
FIG. 7 is a view corresponding to FIG. 6 from the opposite side showing the two smaller openings.
Figure 8:
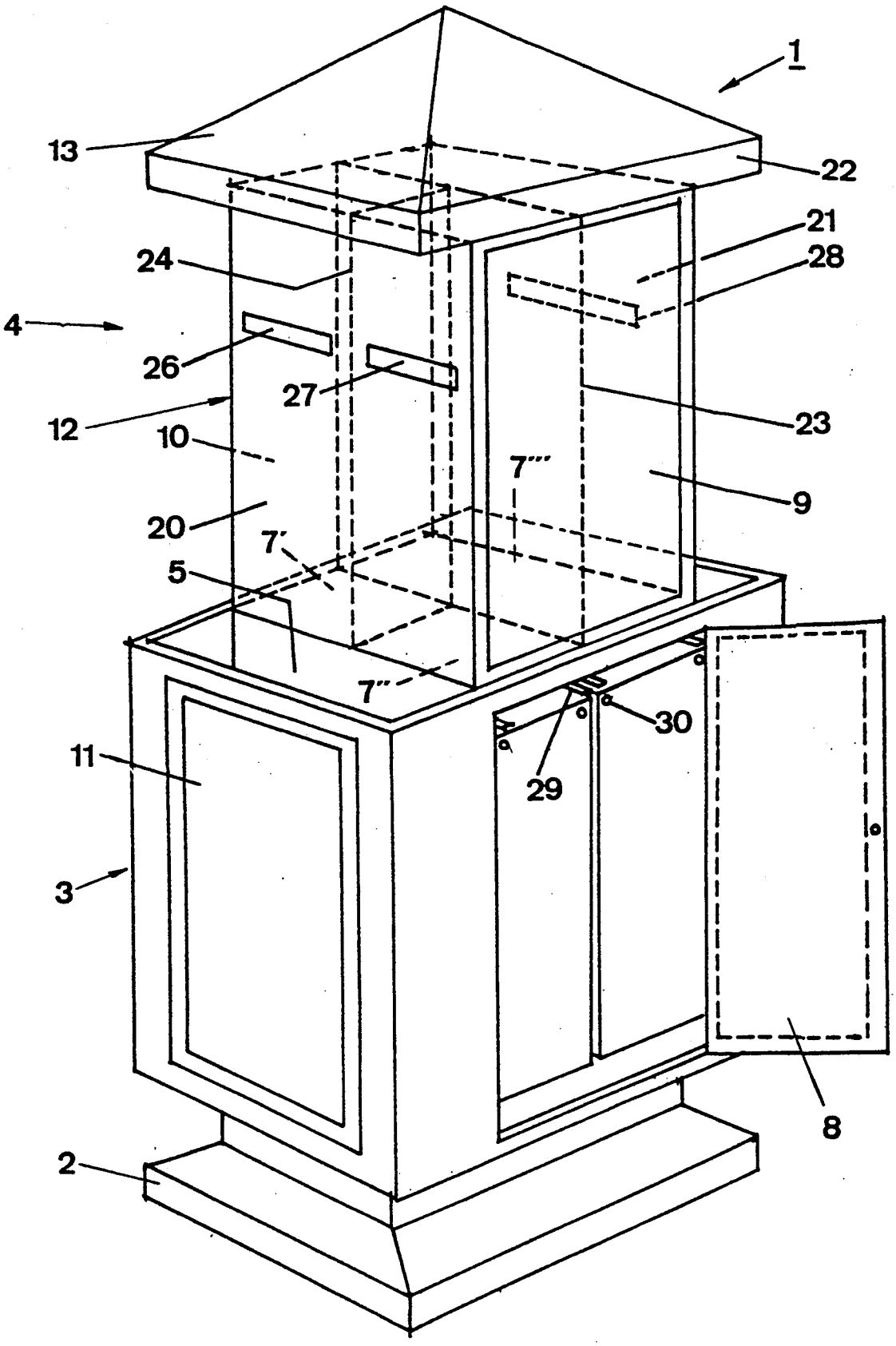
FIG. 8 is a view corresponding to FIG. 7, of the letter box open.

Again in the case of FIG. 5, this letter box will be divided, in its widest direction, that is to say parallel to the access openings (26), (27), (28), vertically into two compartments. One compartment thus constituted, connected to the outside by accedss opening (28), will be reserved, as a result of its substantial volume, for printed matter and envelopes of large dimensions. This compartment is reached and emptied through a door placed under the access opening (28); the other compartment, situated on the side of access openings (26), (27), is divided in two so as to form two more compartments in order to distinguish between mail destined, for example, for Paris and Greater Paris, connected with the outside through access opening (26), and mail destined for the provinces, connected to the outside through access opening (27). These two compartments will be reached through a single door. The embodiment illustrated in FIGS. 6, 7, and 8 is distinguished by a roof (13) identical in form and characteristics to those illustrated in FIGS. 3 and 4. This embodiment is also distinguished by the fact that it is the opposite faces (9), (10) which become display supports, illuminated or not, for advertising posters of 40×60 cm, for example, while face (20) illustrated in FIG. 7 has two access openings (26), (27), for example for mail to Paris and Greater Paris, and for provincial mail, and face (21), illustrated in FIG. 6, has a large access opening (28) for large-format mail. According to another characteristic, illulstrated in FIG. 8, the upper part (4), which communicates at the bottom with the body (3) has, on the inside, a vertical partition parallel to the faces provided with openings and extending into the lower part (3) to divide the furniture in two, one of the halves situated on the side with the two openings, being itself provided with a partition perpendicular to the first to subdivide it again in the upper part (4) into two parts. In this case the body (3) is provided on the inside with rod-type holding means (29) for three bags (7'), (7''), (7''') for collecting the different types of mail. These bags will be suspended on these rods (29) by means of hooks (30) and placed under the openings in the body (3) at the height of the upper part of this body (3). There will be two bags (7'), (7'') side by side, on the side with the two openings (26), (27) and one large bag (7''') on the side with the large access opening (28).

This furniture which has a utilitarian function (collector of refuse or mail), an ecological and decorative function (flower stands, cleanliness), and a benevolent function (recovery of newspapers, easy mailing), also has a safety function, since it can participate in street lighting by the illumination of its six advertising faces when they are made luminous. This furniture, whose primary function is the leasing of the six advertising panels, is intended for placement on the streets or in certain private locations, with the consent of the authorities concerned.

I claim:

1. A container with multiple functions, comprising dual bodies seated one atop the other with a main prism type body resting on a bearing base, said main prism type body having at least four lateral walls and a top surface, at least one receptacle situated within the main body, said top surface having at least one opening for introducing objects into said at least one receptacle, said receptacle being accessible through an access door provided in one of said lateral walls, an upper body of smaller dimension being located centrally on said main body, said upper body defined by at least two side faces extending substantially upwardly from said top surface and separated by a space, so that the opening of the top surface is situated within said space and between said two side faces of the upper body, a roof with at least two inclined surfaces extending between and being supported by said side faces of the upper body, a container being positioned within said upper body spaced between said roof and said top surface of the main body, at least one flower stand is situated at a place of junction between said main and upper bodies and extending from said top surface in the direction of said bearing base, peripheral walls of said flower stand being defined by at least three said lateral walls of the main body, whereby objects can be placed in the container through said space separating said side faces.

2. A container with multiple functions as claimed in claim 1, wherein said at least four lateral walls of said main prism type body support display or advertising panels.

3. A container with multiple functions as claimed in claim 1, wherein said surfaces of the roof protrude with respect to the faces of the upper body, substantially at the vertical of the flower stand.

4. A container with multiple functions as claimed in claim 1, wherein said two faces of the upper body being flat and substantially parallel to each other, each said face being defined by at least top and bottom portions, said roof is positioned between said faces, substantially below said top portions thereof.

5. A container with multiple functions as claimed in claim 2, wherein said door of the main body and said faces of the upper body support display or advertising panels.

6. A container with multiple functions as claimed in claim 1, wherein said container is open on both ends, extends substantially through the length of the upper body and is defined by two sides positioned at an angle to each other.

7. A container with multiple functions as claimed in claim 6, wherein a line of intersection of the sides of the container is positioned substantially perpendicular to a line of intersection of the surfaces of the roof.

* * * * *